United States Patent [19]

Raymond

[11] Patent Number: 4,829,615

[45] Date of Patent: May 16, 1989

[54] TAPERED MATTRESS

[76] Inventor: Edward A. Raymond, 12 Walworth Ave., Scarsdale, N.Y. 10583

[21] Appl. No.: 90,616

[22] Filed: Aug. 28, 1987

[51] Int. Cl.[4] ..... A47C 27/00

[52] U.S. Cl. ..... 5/448; 5/474; 5/505

[58] Field of Search ..... 5/446–448, 5/465, 474, 509, 505

[56] References Cited

U.S. PATENT DOCUMENTS

| | | | |
|---|---|---|---|
| 1,130,946 | 3/1915 | Van Gelder | 5/448 |
| 1,430,946 | 10/1922 | Claggett, Jr. | 5/474 |
| 1,432,875 | 10/1922 | Lavagetto | 5/448 X |
| 1,576,211 | 3/1926 | O'Kane | 5/455 |
| 1,710,400 | 4/1929 | Rebout | 5/465 X |
| 2,545,310 | 3/1951 | Rosberger | 5/447 |
| 2,614,269 | 10/1952 | Hougham | 5/505 |
| 2,675,566 | 4/1954 | Lieberman | 5/447 X |
| 3,747,916 | 7/1973 | Benson | 5/447 X |
| 3,806,614 | 5/1974 | Reinhard | 5/505 |
| 4,207,635 | 6/1980 | Leroy | 5/437 |

*Primary Examiner*—Alexander Grosz
*Assistant Examiner*—Michael F. Trettel
*Attorney, Agent, or Firm*—Morgan & Finnegan

[57] ABSTRACT

A mattress is provided at the head and the foot with inclined surfaces diminishing the thickness of the mattress at those places in order to accommodate the feet and head of the user at these positions on the mattress. A cradle bar may be pivotally mounted adjacent one of the inclined surfaces to hold the bed clothes free of the feet of the user.

4 Claims, 2 Drawing Sheets

TAPERED MATTRESS

The present invention provides a mattress of improved shape and structure which is more comfortable and healthful than other mattresses.

Objects and advantages of the invention will be set forth in part hereinafter and in part will be obvious here from, or may be learned by practice with the invention, the same being realized and attained by means of the instrumentalities and combinations pointed out in the appended claims.

The invention consists in the novel parts, constructions, arrangements, combinations, and improvements herein shown and described.

From time immemorial mattresses have for the most part been constructed in the same rectangular, box-like shape providing a substantially plane upper surface to receive the body of the person using the mattress. This shape has a number of physically undesirable effects upon the body. Considering the upper part of the body of a person when resting on his back on the mattress with pillow(s), it can be shown that there is a pronounced curvature of the cervical and upper dorsal spine. The more pillows that are used, the more curvature of the spine is developed. The conventional mattress thus promotes bad posture of the body of the person who uses it.

There are undesirable effects as well at the foot of the conventional bed. Many people most of the time sleep on their backs. The heel bones project several inches behind the leg bones, and when the feet are upright at the end of the bed, the heels are subjected to undue pressure. The sleeper can seek to avoid this discomfort by rotating the pelvis slightly, laying one foot flat and draping the top leg over the rotated one. This however is an awkward position and leads to frequent shifting of the body in the bed. When heels are subjected to undue pressure as described above, physicians have observed many cases of heel sores which are troublesome and uncomfortable, and may go on to develop into deep gangrenous patches. These conditions may develop into prolonged morbidity and even require surgical intervention.

It is an object of the present invention to provide an improved mattress which affords a more comfortable and healthful rest for the user and at the same time is relatively simple and inexpensive to make. The mattress of the invention meets and corrects problems encountered with mattresses of conventional shape, some of which have been mentioned above.

With the above and other objects in view the mattress of the invention is generally rectangular and box-like in shape and made of the same materials as a conventional mattress, but at each end the mattress is tapered in depth so that the thickness of the mattress at the ends is substantially less than through the central part of the mattress. Thus, when a pillow is used under the head of the user the pillow lies on a downwardly inclined portion of the mattress and the cervical and upper dorsal spine of the user is substantially straight. At the opposite end of the mattress the feet are positioned on a downwardly inclined part of the mattress, and the heels are not subjected to undue or harmful pressure.

A modification of the invention provides a cradle bar pivotally mounted at one end of the mattress where the feet will be positioned, which may be upwardly positioned to protect the feet as they are positioned on the downwardly inclined surface at the end of the mattress and further relieve pressure of the bed clothes on the feet. The cradle bar may be readily removed entirely from the mattress when not needed, or alternatively it may be pivoted downwardly over the end of the mattress and thus be positioned out of the way.

Another modification of the mattress of the invention provides the rectangular box-like mattress with tapered ends referred to above but with a rim of uniform height that extends the entire length of the sides of the mattress including the tapered ends. In this form the mattress has shallow triangular cavities (in cross-section) at each end, and the inclined ends are somewhat less flexible than in the preferred embodiment.

It will be understood that the foregoing general description and the following detailed description as well are exemplary and explanatory of the invention but are not restrictive thereof.

Figure 1:
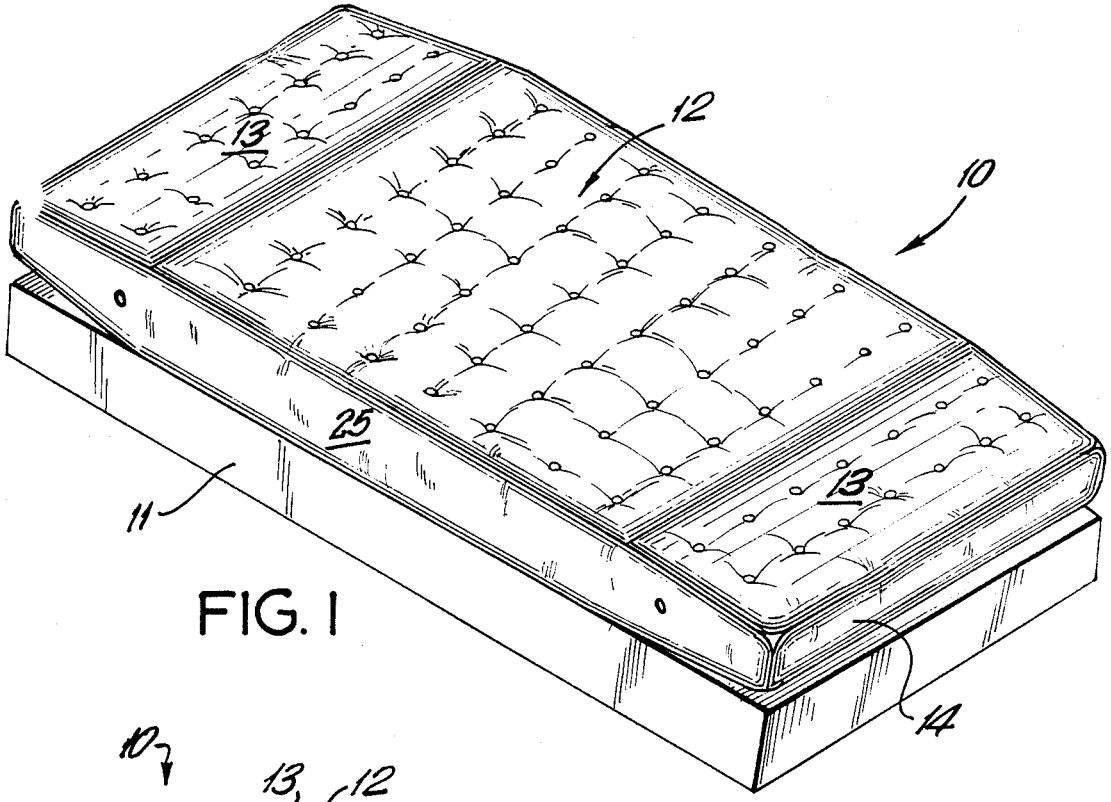
FIG. 1 is a perspective view of the mattress of the invention in place upon a set o conventional box springs.
Figure 2:
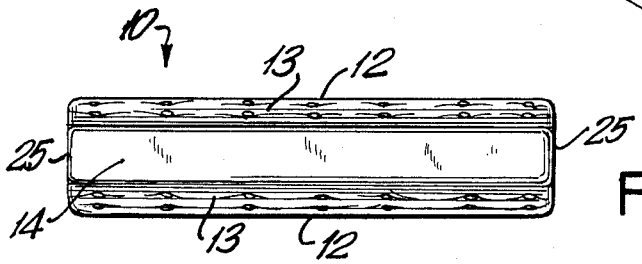
FIG. 2 is an end elevational view of the mattress shown in FIG. 1.

Referring now in detail to the embodiments of the invention shown in the drawings, there is shown in FIG. 1 the mattress of the invention 10 in place upon a set of conventional box springs 11. The mattress 10 is provided with central substantially plane surfaces 12 forming both upper and lower surfaces of the mattress, joined by sides 25. The surfaces 12 are substantially parallel to each other, the mattress at these places being formed substantially the same as a conventional mattress. At each end of the mattress, however, it is provided with substantially plane surfaces 13 both above and below in prolongation with respective ones of central surfaces 12, which form transverse lines of intersection with central surfaces 12 and which converge toward each other and terminate at the ends 14 of the mattress. There is thus formed a mattress which provides the main bearing surface 12 centrally of the mattress which is gently tapered at both ends merging into the surfaces 13.

Figure 3:
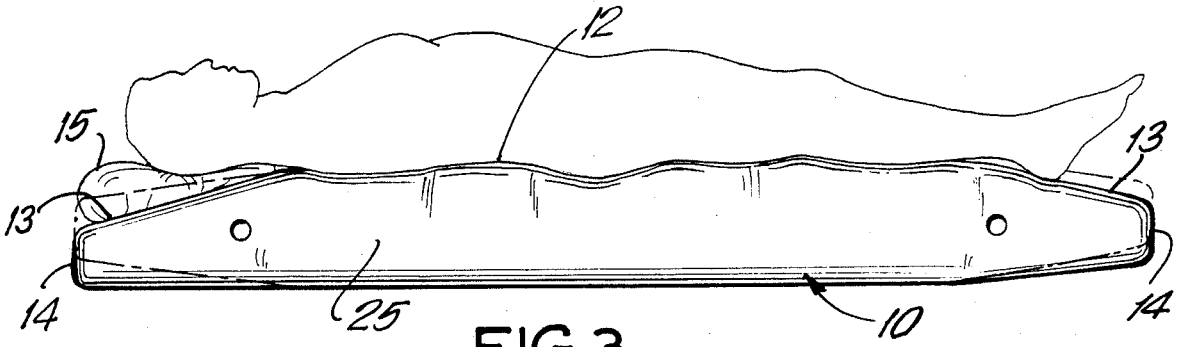
FIG. 3 is a side view of the mattress shown in FIG. 1 illustrating the mattress in use with a pillow at the head of a person lying on his back on the mattress.

FIG. 3 shows a person reclining on the mattress on his back with his head on a pillow 15 which is supported on a surface 13, and with his feet on a surface 13 at the opposite end. As shown in full lines, in use the tapered ends of the mattress will tend to slump downwardly toward or against the supporting box springs due to the weight of the head and feet of the user. The dotted lines in FIG. 3 show the original position of the tapered ends of the mattress before the body is in position on the mattress.

Figure 4:
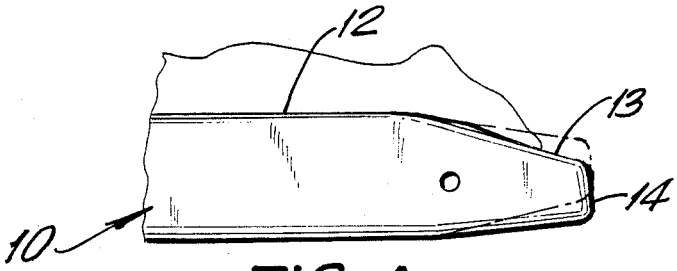
FIG. 4 is a fragmentary view of the mattress shown in FIG. 1 showing the position of the feet at the bottom of the mattress when the user is lying on his stomach.

FIG. 4 shows the foot end of the mattress 10 where the user lies on his stomach on the mattress, illustrating that the feet are comfortably and healthfully accommodated by an inclined surface 13 of the mattress when the user is in this position.

For purposes of illustration only, a mattress 10 embodying the invention might be 75 inches long and 38 inches wide, with the inclined surfaces 13 commencing some 13 or 14 inches from the ends 14 of the mattress. The ends 14 of the mattress may be some 4 inches in thickness, with the thickness at the central part of the mattress between the surfaces 12 some 8 inches. The surfaces 13 thus incline gently toward each other toward the ends of the mattress, being spaced some 8 inches apart where they merge along transverse lines of intersection into surfaces 12, and being spaced 4 inches apart where they meet the ends 14. As shown in FIG. 3, of course, the inclination of each tapered end as a whole is modified when the mattress is in use and the ends are depressed. It will be appreciated that the measurements mentioned herein are in no sense critical, and are set out here entirely for purposes of illustration and not in limitation.

The mattress 10 may be manufactured of conventional materials which are well known to those familiar with the art. It will be seen from the foregoing description that the mattress of the invention is easy and economical to make, it may be reversible as is the case of the conventional mattress, and it is healthful and comfortable to use in all sleeping positions, whether back, stomach or side.

The mattress differs significantly from and has substantial advantages over mattresses known in the art. The patent to Lavagetto U.S. Pat. No. 1,432,875 of Oct. 24, 1922 discloses a mattress with rounded sleeping surface which is tapered in thickness continuously from the head to the foot of the mattress. This differently shaped mattress would have none of the advantages which have been noted for the present invention. The patent to Leroy U.S. Pat. No. 4,207,635 of June 17, 1980 discloses a mattress of varying thicknesses at various places in the mattress. It does not in any way suggest, however, the mattress of the invention having tapered ends with the purposes and functions which have been discussed. The invention is believed to provide significant advantages over any mattress heretofore known in the art.

Figure 5:
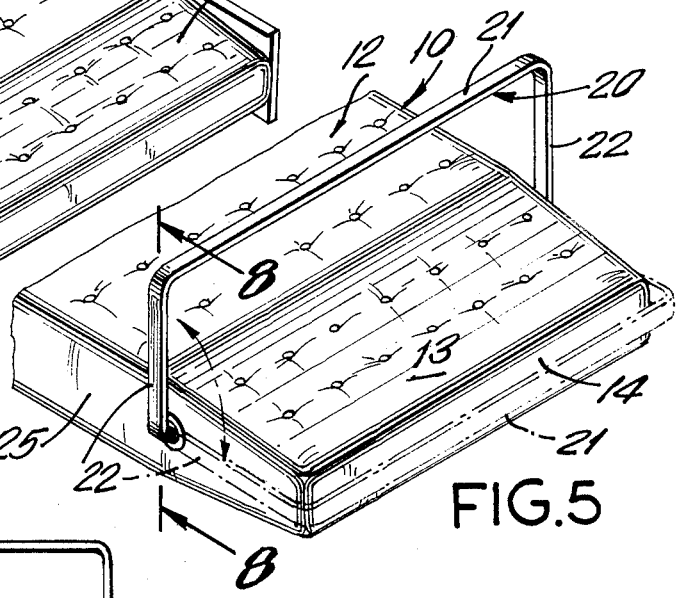
FIG. 5 is a fragmentary view of a mattress generally of the form shown in FIG. 1, and fitted with a cradle bar pivotally secured at one of the tapered ends of the mattress.
Figure 6:
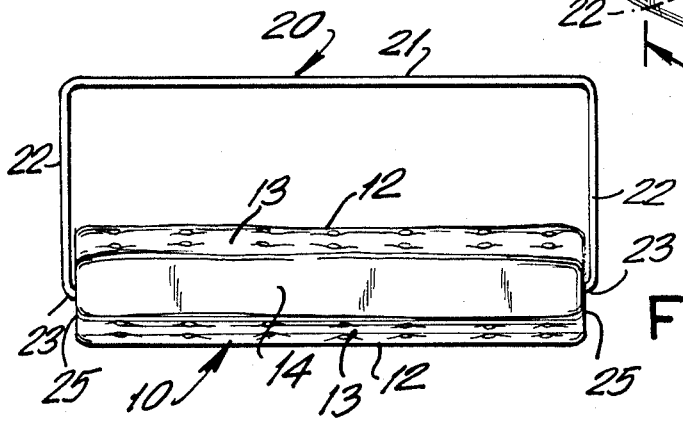
FIG. 6 is an end elevation of the embodiment shown in FIG. 5.

The mattress 12 shown in FIG. 5 may be generally the same as already described in connection with the earlier figures. In this embodiment a cradle bar 20 is provided at one end of the mattress which protects the feet when needed for various reasons, such as in cases of burns or dermatitis. A bulky cradle structure is commonly used in hospitals to be supported on the end of the mattress over the feet of the patient to protect from the weight of the bed clothes. In the present invention the cradle bar 20 which is made in the form of a rectangular letter U with a top reach 21 and side reaches 22 each of which ends in an inwardly turned end 23, as best shown in FIG. 6. Each turned end 23 is received within a dished bearing piece 24 (FIG. 8), and these pieces are positioned in a depressed portion of each side wall 25 of the mattress. A headed pin 26 passes through the side wall 25 of the mattress, the baring piece 24, and the end 23 of each side reach 22. The cradle bar 20 is thus pivotally mounted on the two sides 25 of the mattress so that it may be elevated to support the bed clothes 27 (FIG. 7) and protect the feet, and may be lowered, as shown in dotted lines, to be out of the way when not in use. The countersunk rotary mounting of the cradle 20 with respect to the sides 25 of the mattress serves to protect the bed clothes from tearing.

Figure 7:
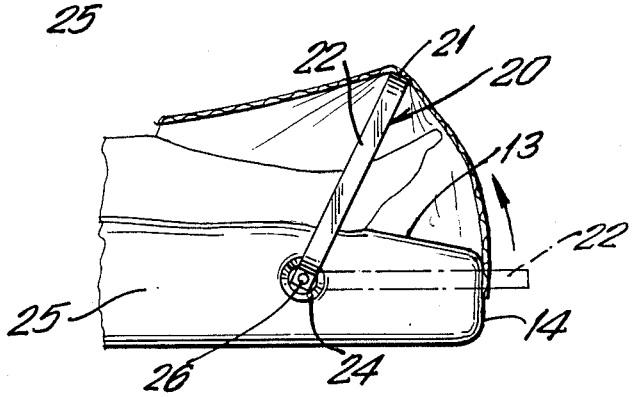
FIG. 7 is a fragmentary side elevation of the embodiment shown in FIG. 5.
Figure 8:
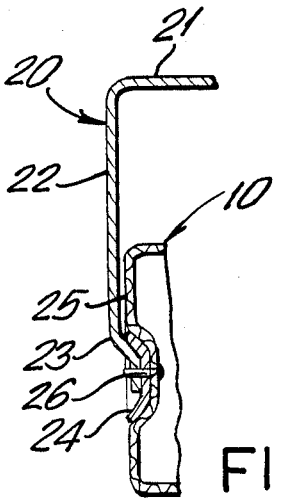
FIG. 8 is a sectional view taken along line 8—8 of FIG. 5.

The cradle bar 20 is preferably made of resilient or springy material such as metal or plastic, for instance, so that the bar may be readily removed entirely from the mattress if desired merely by displacing the side reaches 22 outwardly so that the ends 23 are clear of the pins 26. It will be seen that the cradle bar 20 cooperates with the tapered shape of the mattress to accommodate and protect the feet as shown in FIG. 7, and that the height of the cradle protecting structure above the bed is less than is necessary in the conventional practice, due to the tapered end of the mattress to receive the feet.

Figure 9:
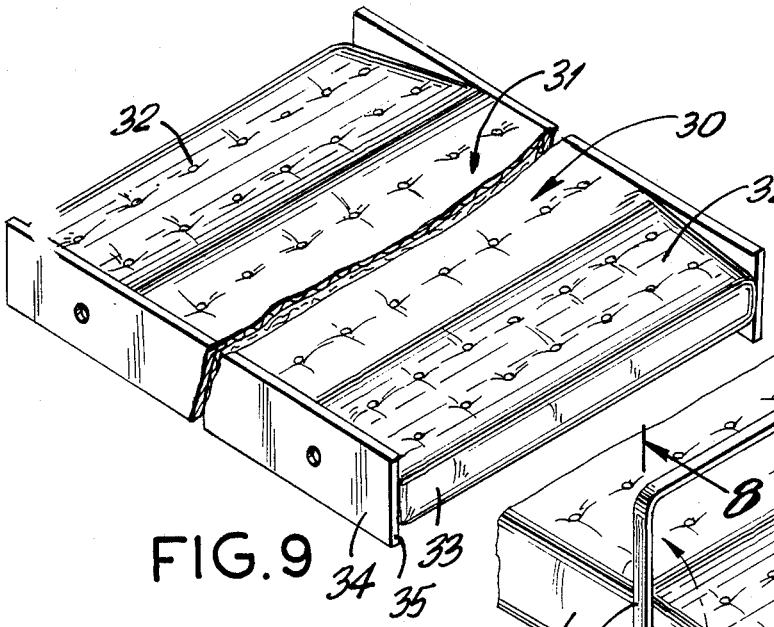
FIG. 9 is a fragmentary perspective view of a modified embodiment of the invention showing the tapered mattress with a rim of uniform height extending along the entire length of the sides of the mattress including the tapered ends.

FIG. 9 shows a modified embodiment of the mattress. The mattress 30 of this embodiment is formed very much as the embodiment of FIG. 1 with substantially plane and parallel upper and lower surfaces 31 throughout the central extent of the mattress which merge along transverse lines of intersection into substantially plane inclined surfaces 32 terminating in the ends 33 of the mattress. In this structure the lateral sides 34 of the mattress are of substantially uniform width along the entire length of the mattress, rather than being tapered along the side extents of tapered surfaces 32. There are thus provided rim portions 35 of the sides 34 which extend at substantially right angles to the inclined surfaces 32. Such a structure might be desired to help retain a pillow in place, to limit somewhat the depression of the tapered ends of the mattress when in use, and perform for other purpose.

The invention in its broader aspects is not limited to the specific mechanisms shown and described but departures may be made therefrom within the scope of the accompanying claims without departing from the principles of the invention and without sacrificing its chief advantages.

What I claim is:

1. In a mattress having a rectangular three dimensional structure with a substantially plane body receiving surface throughout the central extent of the mattress and extending to each lateral side of the structure, the improvement which comprises an inclined substantially plane body receiving surface at each end of the structure in prolongation of said central surface and angularly disposed with respect thereto along lines of intersection of said central surface with said inclined end surfaces which lines are transversely disposed with respect to said structure, serving to diminish the thickness of the structure at the ends.

2. A mattress as claimed in claim 1 having a U shaped cradle bar pivotally connected to the sides of said mattress structure adjacent an inclined surface whereby the bar can protect feet which are positioned on said inclined surface.

3. A mattress as defined in claim 1 having a rim portion in prolongation of each side of the mattress structure and of substantially the same height as said side with a rim portion extending entirely along each side of each inclined surface and at substantially a right angle with respect thereto.

4. In a rectangular mattress having a pair of spaced apart substantially plane and substantially parallel body receiving surfaces throughout the central extent of the mattress and extending to each lateral side of the mattress, the improvement which comprises an inclined substantially plane body receiving surface in prolongation of each of said central surfaces at each end thereof and angularly disposed with respect thereto along lines of intersection of said central surfaces with their respective inclined end surfaces which lines are transversely disposed with respect to the mattress, said inclined surfaces being arranged to diminish the thickness of the mattress at each end thereof.

* * * * *